US006691938B2

(12) United States Patent
Bradshaw

(10) Patent No.: US 6,691,938 B2
(45) Date of Patent: Feb. 17, 2004

(54) METHOD AND APPARATUS FOR HYDROATTRITION SCRUBBER

(75) Inventor: Richard J. Bradshaw, Prescott Valley, AZ (US)

(73) Assignee: Hydro-Attrition Scrubbers LLC, Willcox, AZ (US)

( * ) Notice: Subject to any disclaimer, the term of this patent is extended or adjusted under 35 U.S.C. 154(b) by 474 days.

(21) Appl. No.: 09/863,238

(22) Filed: May 21, 2001

(65) Prior Publication Data

US 2002/0182981 A1 Dec. 5, 2002

(51) Int. Cl.[7] ..... B02C 19/06
(52) U.S. Cl. ..... 241/39; 241/5
(58) Field of Search ..... 241/5, 39; 423/23, 423/27, 29, 47, 658.5; 75/354, 356

(56) References Cited

U.S. PATENT DOCUMENTS 2,846,150 A * 8/1958 Work
3,643,875 A * 2/1972 Dille et al.
3,895,760 A * 7/1975 Snyder

* cited by examiner

*Primary Examiner*—Mark Rosenbaum
(74) *Attorney, Agent, or Firm*—Joseph W. Mott

(57) ABSTRACT

A method and apparatus are disclosed for separating target particles from surrounding materials such as separating gold particles from the clays in placer deposits. The enveloping material is converted to a slurry, then pumped into a collision chamber through pairs of opposing nozzles. Sets of slurry collide, dislodging target particles from surrounding material. The outgoing slurry is then further processed to separate the particles dislodged by the collision.

4 Claims, 5 Drawing Sheets

METHOD AND APPARATUS FOR HYDROATTRITION SCRUBBER

FIELD OF THE INVENTION

The invention relates generally to the methods and apparatus for separating hydrous slurries into two or more fractions through collision scrubbing. High velocities are created for attrition collisions to facilitate particle separation.

BACKGROUND OF THE INVENTION/PRIOR ART

Various methods and apparatus have been used to separate slurries containing solids into several fractions to aid in extraction of the target mineral. Many sizing and classifying methods employ gravity separation, the separation being dependent on the difference in the settling rates or settling velocities of the particles in a relatively quiescent body of water. The different settling velocities of the solid particles of the slurry may be by virtue of particles differing in size, particles of different substances differing in their densities, or both.

Methods and apparatus of this type are subject to certain disadvantages and limitations. For example, the separation may not be as sharp as desired, particularly for certain types of slurries. The sharpness of separation tends to be subject to variations, which generally occur when there are changes in the solids content of the feed or in the relative amounts of the solids in the feed having different settling velocities. Also, the apparatus may be excessively elaborate in structural detail and size for the capacity or sharpness of separation desired. For a given processing capacity, the size of such equipment is relatively large.

Beyond gravity separation, other means of separating mineral ore involve various mechanical and chemical processes. Mechanical processes include: rotary scrubbers, which roll and tumble rock in water; log washers, which have paddles to scrub and transport the material from one point to another; pebble attrition or autogenous mills, which are rotary turning barrels that tumble the rock and particles in water and pass the same on to the next process; wet vibrating screens, which hydrate the material during agitation; high speed paddle blenders, which are batch mixes and not suited for continuous flow; and pulverization.

The disadvantages to these processes include the rate at which ore can be processed and the expense. Alluvial ore deposits require thousands of tons of raw material to be mined, processed, and refined daily. The current methods and apparatus either cannot efficiently process the large amounts necessary in mining or are cost prohibitive.

An object of the invention is to improve upon hydraulic separating methods and apparatus, particularly with respect to providing an efficient and economical means to separate mineral ore at a desired sharpness of separation.

Another object of the invention is to provide an apparatus that is relatively simple in construction and operation, which provides for changes in the character and rate of feed slurry.

SUMMARY OF THE INVENTION

When alluvial or placer deposits of ore are mined, large amounts of unwanted material surround the target mineral. For example, gold particles or granules are encased in the local variety of clay. In many types of such ore processing, it is customary to add water to the ore mixture to produce a slurry that facilitates mechanical processing. The present invention is an efficient way of dislodging the unwanted material from the target mineral carried in the slurry. The invention also permits changes in the flow rate and viscosity of the slurry mixture using a simple and economical apparatus. The flow rate of the slurry mixture can be adjusted to accommodate different particle sizes and varying viscosity and to promote effective scrubbing of mineral-bearing ore.

In one embodiment of the invention, a hydrous slurry mixture of the ore is pumped via hydrostatic and other pressure at a continuous flow rate into a receiving cylinder. Then, the mixture is pumped through two small openings on opposite walls of a hollow tube inserted into the receiving cylinder. These openings are positioned so that a jet of slurry flows from each hole and the jets collide in the center of the tube. This collision occurs at atmospheric pressure and causes clay and other particles to be dislodged from the mineral ore. The flow into the tube is controlled by the size of the nozzle, and the incoming pressure which may be adjusted to the required velocity for the collision. The dislodged material and scrubbed particles then fall out of the tube for further processing.

DETAILED DESCRIPTION OF THE INVENTION

The present invention generally provides for a container with an opening at the top by which a pressurized slurry mixture is introduced into the system and jets at the bottom through which the slurry mixture is pumped.

Figure 1:
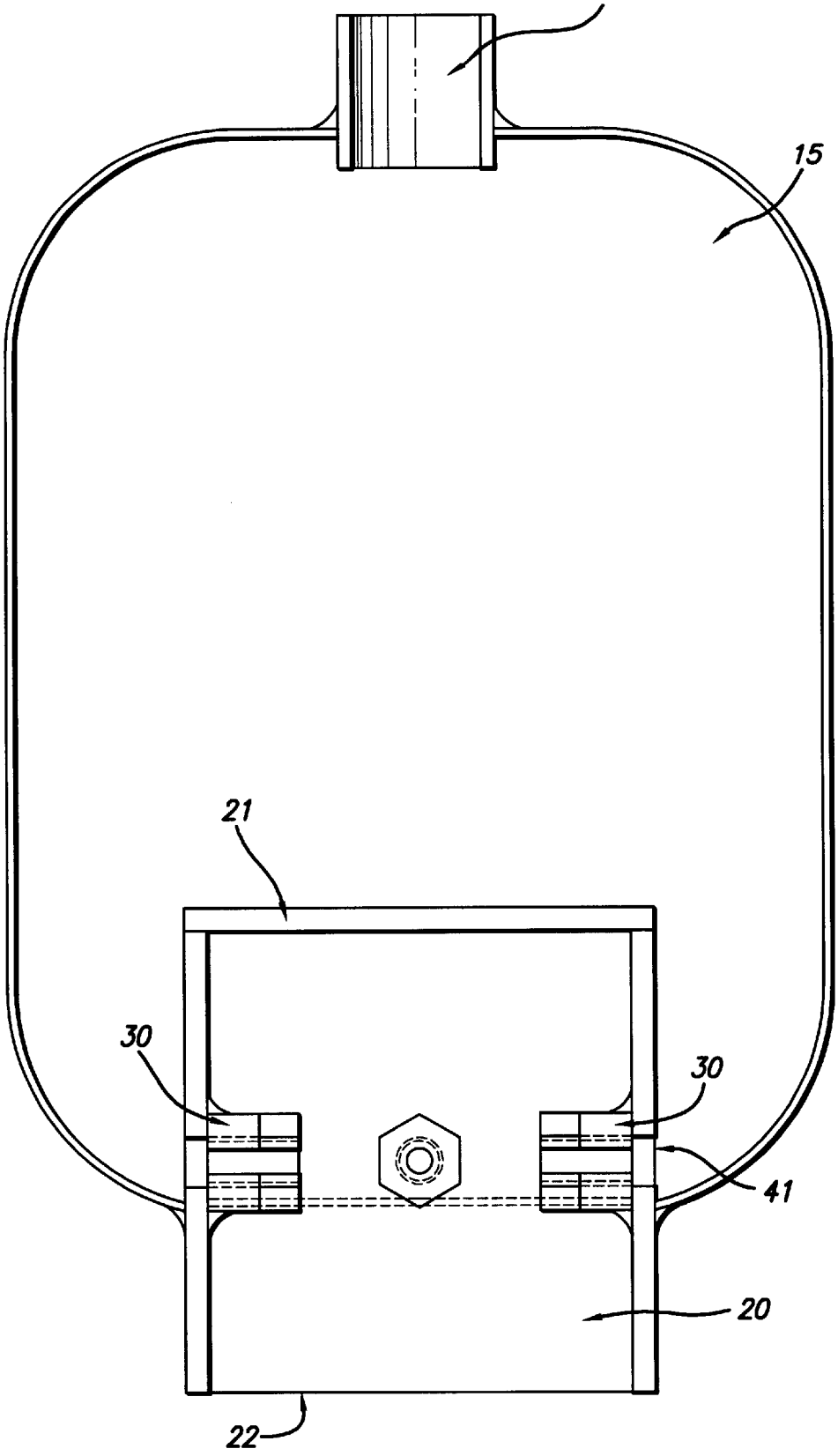
FIG. 1 is a side view of the system illustrating the preferred embodiment of the apparatus in accordance with the present invention.

FIG. 1 is a diagrammatic representation showing a vertical cross-section of the device. This embodiment of the invention has a chamber or receiving cylinder 15 made of steel or another adequate material to withstand the high pressure needed to separate particles from the mineral ore. For a prototype purpose and implementation in a small-scale operation, a standard five gallon propane cylinder in common use has proven satisfactory. A prototype operation was set up with four cylinders attached to a steel manifold for even distribution of slurry to each scrubber. See FIG. 5. Two stages of scrubber are used, and the system is capable of processing 30 tons per hour of ore.

The chamber has an entry opening 10 the same size as the end of a low friction feed line (not shown). The end of the feed line fits securely over the entry opening 10 and allows a hydrous slurry of mineral ore to pass into the chamber. The feed line should be have a sufficient diameter and be made of a durable material to withstand a pressurized slurry mixture to be fed into the chamber or receiving cylinder.

Figure 2:
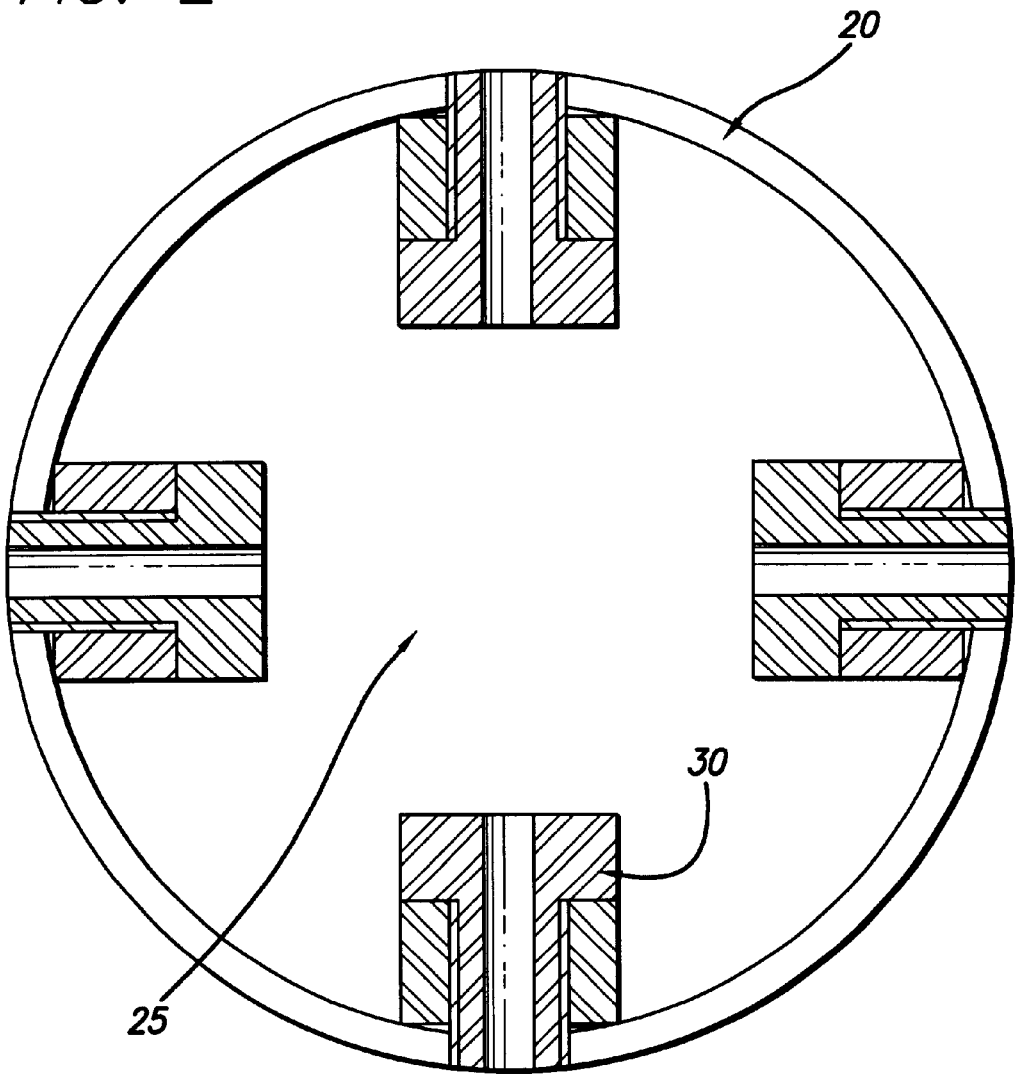
FIG. 2 is a cross-sectional top view illustrating the nozzle configuration.

At the lower end of the receiving cylinder there is a discharge tube 20, capped at the top 21 and open at the bottom 22. The discharge tube has pairs of nozzles 30, which are positioned directly across from each other. The discharge tube is unrestricted, centralized and strong enough to withstand the pressure difference between the charged chamber and atmospheric pressure. The nozzle 30 should have a sufficient diameter and be made of a durable material to allow the slurry mixture to pass at high velocity without clogging or obstruction. A plurality of discharge nozzles may be positioned so that a jet of slurry flows from from each nozzle and collides in the center area 25 of tube 20 as shown in FIG. 2.

Figure 3A:
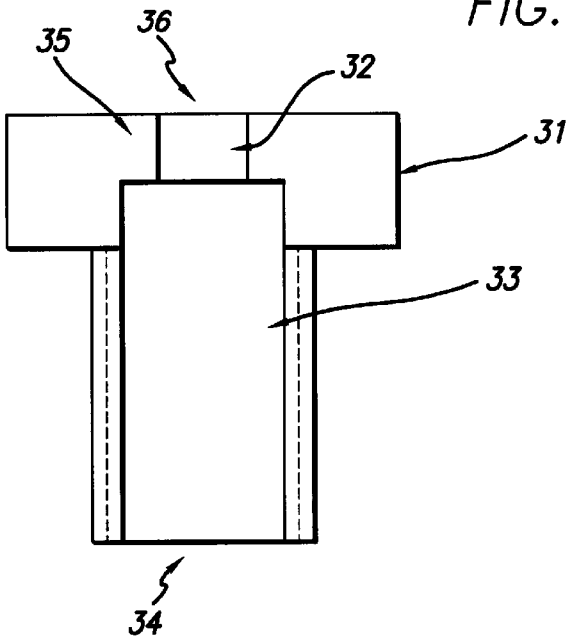
FIG. 3*a* is a detail in section illustrating a nozzle, nozzle receptacle and nozzle retainer.
Figure 3B:
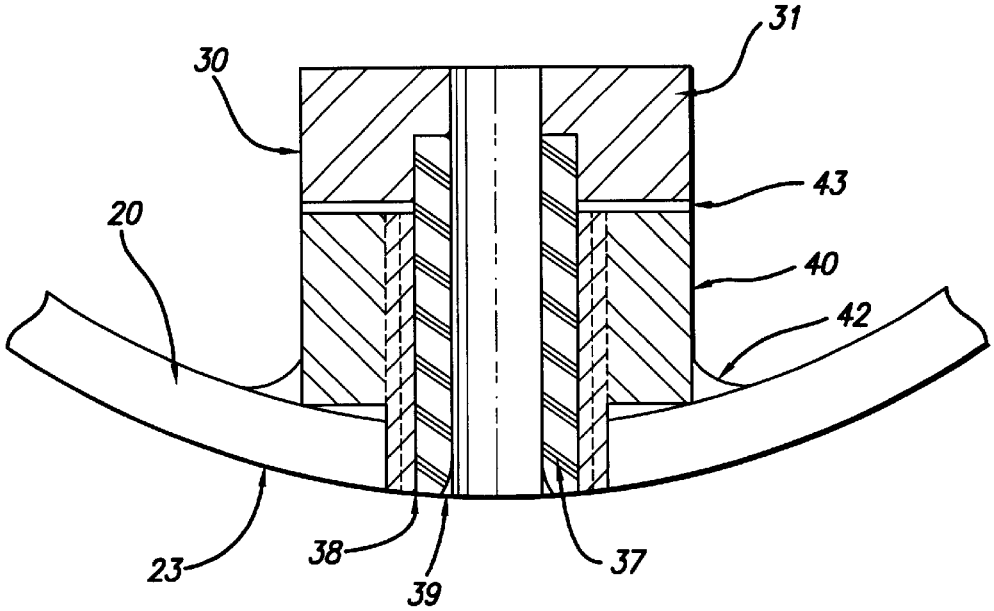
FIG. 3*b* is a detail in section illustrating a nozzle.

FIGS. 3*a* and 3*b* show an enlarged representation of the nozzle and nozzle assembly. Nozzle 30 must be constructed of a material strong enough to withstand the wear and pressure. For the prototype operation, standard ¾-10× steel bolts with 1" hex heads 31 were drilled lengthwise to create a ⅜" diameter barrel 32. The bolt is counterbored with a 9/16" shaft 33 from the intake 34 to a distance of about 1–1¼", allowing a shoulder 35 to remain in the bolt head 31 short of the discharge outlet 36. An insert 37 of a suitable smooth and durable lining material, preferably polyurethane or carbide, with the same inside diameter as the barrel 32 and the same outside diameter as the counterbored shaft 33, is inserted into the shaft, bonded and shouldered up. In the prototype, the insert has a ⅜" inside diameter, 9/16" outside diameter and is bonded to the bolt shaft with epoxy 38. Preferably, the insert has a rounded entry 39 to make inflow into the nozzle more efficient.

The nozzle retainer in the prototype is a ¾-10 steel hex 40 nut which is centered over a 9/16" hole 41 in the discharge tube and welded 42 to the inside surface of the discharge tube 20. The nozzle bolt 30 is threaded into the retainer nut 40 for a tight fit that is flush with the outer surface of the discharge tube 23. Optionally, a flat washer 43 may be used between the bolt head and the nut. When the insert wears out, the nozzle is unscrewed from the retainer and replaced. The retainer nut and nozzle bolt may be selected so that a range of nozzle barrel sizes can be accommodated.

For an apparatus on the scale of the described prototype, the nozzle lengths are optimally about one inch and the barrels ⅜ inch or ¾ inch. The combination of nozzle size and input pressure should be set to achieve a nozzle exit velocity of about six meters per second. Bore diameters must accommodate the largest expected solid particles in the slurry.

The unit may contain two nozzles, but should optimally contain four nozzles. Larger scale apparatus may include more nozzles. The nozzles are positioned in pairs directly across from each other, so that a jet of slurry is forced from opposing holes and the jets collide in the center of the tube. It is important to optimal operation that the particles collide with each other and not with the nozzles or other parts of the apparatus.

Once the apparatus is constructed according to the foregoing specifications, a feed slurry of the particulate ore material is pumped via hydrostatic, hydraulic or other pressure at a continuous flow rate into the entry opening 10. The hydrous slurry fills the chamber 15 and is forced through the nozzle assemblies 30, causing the expelled jets of material to collide in the center area 25 of discharge tube 20 at atmospheric pressure. Clay and other particles are thereby dislodged from the mineral ore by the force of the collision. The separated particles drop out the bottom 22 of discharge tube 20 to the next processing step which may be, for example, mesh screen separation or still water gravity concentration.

A laboratory test should determine the size of particles, the type of clay and type of verities present, and the ratio of clay to mineral solids in the ore to be processed. Successful recovery has been accomplished with slurries containing 3% to 15% clay in solids and gold concentrations between one gram and one-half ounce per ton. Slurry densities of 5% to 40% were tried, and the best results were achieved at 25% to 30% slurry density.

Particle size may be ascertained by sieve analysis of the input slurry. Gold particles larger than ⅜" can be scrubbed in another device. Particles between ⅜" and 20 mesh would be scrubbed in a hydroattrition device with ¾" nozzles. Smaller sized particles will be processed with the ⅜" nozzles. Table 1 shows the relationship of nozzle pressure, flow rate and collision requirements for 25% to 30% slurries with target particles small enough for a ⅜" nozzle.

| Nozzle Pressure Lbs/sq.in. | ⅜" Nozzle Gal/per min. | Required Collisions |
|---|---|---|
| 10 | 13.3 | multiple - 60 min. |
| 15 | 16.3 | multiple - 45 min. |
| 20 | 18.7 | multiple - 30 min. |
| 25 | 21.0 | multiple - 15 min. |
| 30 | 23.1 | multiple - 08 min. |
| 35 | 25.0 | multiple - 04 min. |
| 40 | 26.6 | one collision 90% |
| 45 | 28.2 | one collision 95% |
| 50 | 29.9 | one collision 99% |

The table shows the number of cycles through the hydroattrition scrubber needed at various pressures to liberate at least 90% of the target materials in the slurry. For nozzle pressures between 10 psi and 35 psi, the slurry had to be recycled through the scrubber to achieve the desired liberation percentage (60 times at once per minute at 10 psi and four times at once per minute at 35 psi). A single collision at 40 psi liberated 90% of the target materials, while a single collision at 50 psi liberated over 99%.

Figure 4:
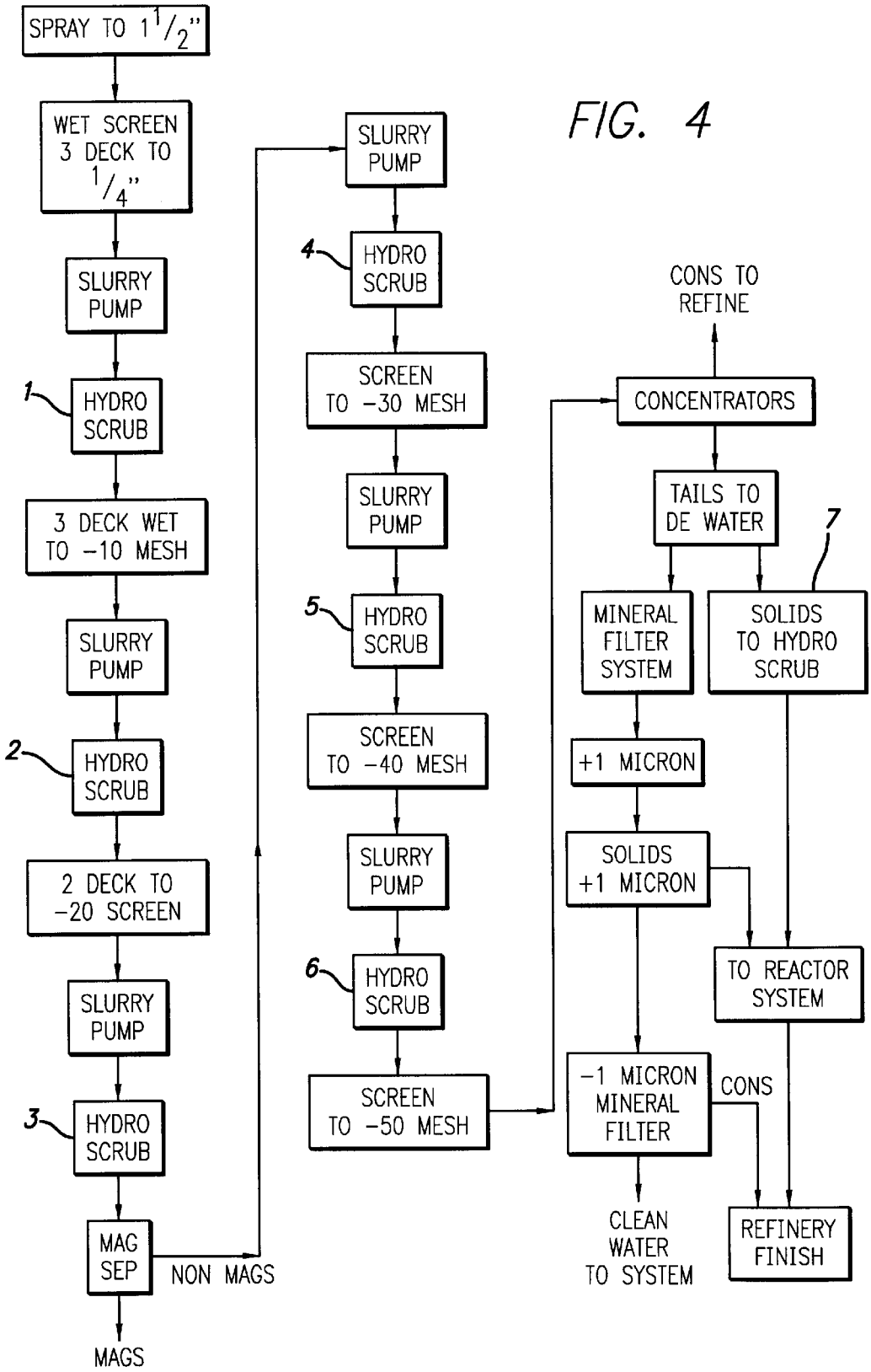
FIG. 4 is a flow chart schematically depicting a preferred embodiment of the process of the present invention.
Figure 5:
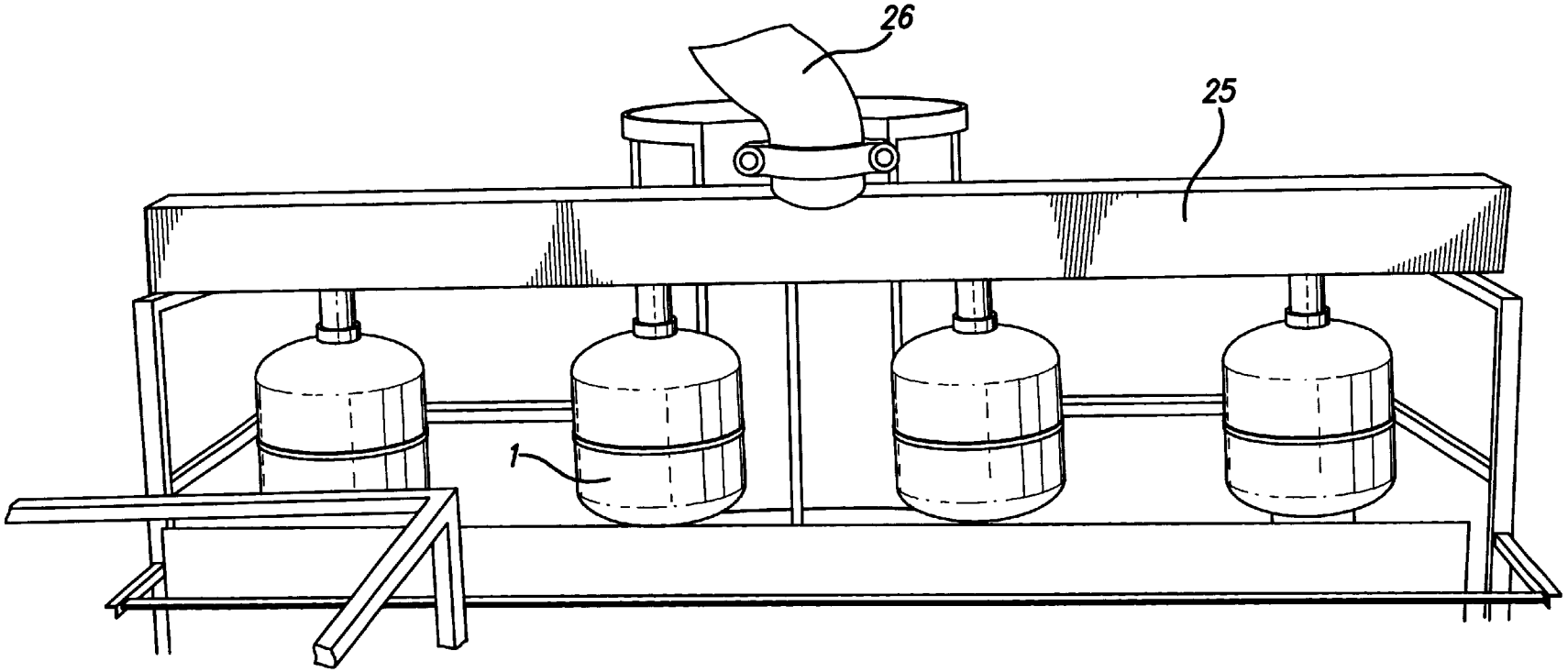
FIG. 5 depicts an arrangement in which four units of the apparatus are integrated into a refining operation through the use of a manifold.

The hydroattrition scrubber is useful at several stages of a refining operation. FIG. 4 shows a process flow for a sample gold refiner for placer deposits, in which seven hydroattrition scrubbers 1 to 7 are incorporated. FIG. 5 illustrates the use of multiple hydroattrition scrubbers 1 in parallel, connected by a manifold 25 fed by master input hose 26 to increase the throughput at a particular stage of the ore processing.

Although the present invention has been described in detail with reference to certain preferred versions thereof, those skilled in the art will note that the spirit and scope of the appended claims is not limited to the preferred version.

What is claimed is:

1. A hydroattrition scrubber for separating target minerals in a slurry from surrounding attached materials, comprising a main container having a pressure chamber, a top opening for input of the slurry under pressure and a bottom opening;

a discharge tube with a closed top and an open bottom placed in the container bottom opening so that an upper portion of the tube is in the pressure chamber and a lower portion of the tube is outside the pressure chamber;

a plurality of nozzles located in the discharge tube in opposing pairs so that slurry is forced from the pressure chamber through each nozzle in a jet that collides in a center portion of the discharge tube with a jet of slurry from an opposing nozzle.

2. The scrubber of claim 1 wherein the nozzles comprise drilled-through barrels in steel bolts threaded into nuts welded to the inside surface of the discharge tube over holes in the discharge tube.

3. The scrubber of claim 2 wherein each nozzle further comprises a counter-drilled partial shaft slightly larger than the drilled-through barrel and a polymer insert fitted into the shaft.

4. The scrubber of claim 1 further including a source of pressurized slurry attached to the top opening.

* * * * *